US009874852B2

(12) United States Patent
Boyatt, III et al.

(10) Patent No.: US 9,874,852 B2
(45) Date of Patent: Jan. 23, 2018

(54) HEATER MEMBER FOR THE FUSER ASSEMBLY OF AN ELECTROPHOTOGRAPHIC IMAGING DEVICE

(71) Applicant: Lexmark International, Inc., Lexington, KY (US)

(72) Inventors: Richard Gordon Boyatt, III, Lexington, KY (US); Alexander Johannes Geyling, Lexington, KY (US); Edward Lawrence Kiely, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 172 days.

(21) Appl. No.: 14/926,392

(22) Filed: Oct. 29, 2015

(65) Prior Publication Data

US 2017/0023910 A1 Jan. 26, 2017

Related U.S. Application Data

(60) Provisional application No. 62/194,801, filed on Jul. 20, 2015.

(51) Int. Cl.
*G03G 21/16* (2006.01)

(52) U.S. Cl.
CPC ..... *G03G 21/1685* (2013.01); *G03G 21/1647* (2013.01); *G03G 2215/2035* (2013.01)

(58) Field of Classification Search
CPC ..... G03G 21/1647; G03G 2215/2035; G03G 21/1685
See application file for complete search history.

(56) References Cited

U.S. PATENT DOCUMENTS

| | | | | |
|---|---|---|---|---|
| 5,316,539 | A | 5/1994 | Leemhuis | |
| 6,002,913 | A | 12/1999 | Pawlik | |
| 6,285,846 | B1 | 9/2001 | Suzuki | |
| 8,306,457 | B2 * | 11/2012 | Saiki | G03G 15/20 399/122 |
| 8,725,039 | B2 | 5/2014 | Tanda | |
| 2014/0369725 | A1 | 12/2014 | Bayerle | |

OTHER PUBLICATIONS

International Search Report; PCT/US2016/042983; Oct. 13, 2016.

* cited by examiner

*Primary Examiner* — Gregory H Curran

(57) ABSTRACT

A fuser assembly, including a heat transfer member; a backup member disposed adjacent the heat transfer member so as to form a fuser nip; a frame in which the heat transfer member and the backup member are at least partly disposed; and a cover member pivotably coupled to the frame so as to pivot between a closed position and an open position, the cover member in the open position providing an opening for accessing and withdrawing a sheet of media disposed in the fuser assembly. A latch mechanism selectively latches the cover member to the frame and including a lever member disposed relative to an outer surface of the cover member such that movement of the lever member by a single hand of a user unlatches the cover member from the frame for moving the cover member to the open position.

18 Claims, 7 Drawing Sheets

120

HEATER MEMBER FOR THE FUSER ASSEMBLY OF AN ELECTROPHOTOGRAPHIC IMAGING DEVICE

CROSS REFERENCES TO RELATED APPLICATIONS

The present application is related to and claims priority under 35 U.S.C 119(e) from U.S. provisional application 62/194,801, filed Jul. 20, 2015 and entitled, "Fuser Having One-Handed Jam Access Operation," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to fusing toner to sheets of media, and particularly to a fuser assembly for an electrophotographic imaging device which provides for internal access to the fuser assembly via simple manipulation by a user of the imaging device.

2. Description of the Related Art

Some governments, such as the U.S. government, have requirements to make its electronic and information technology accessible to people with disabilities. Products considered to be self-contained, closed products are ones which generally have embedded software and are commonly designed in such a fashion that a user cannot easily attach or install assistive technology. These products include, but are not limited to, information kiosks and information transaction machines, copiers, printers, calculators, and facsimile machines. With respect to federal agencies of the U.S. government, the accessibility requirements for self-contained, closed products are established in Section 508 of the U.S. Rehabilitation Act. The Act requires self-contained, closed products maintained by federal agencies to be usable by people with disabilities without requiring an end-user to attach assistive technology to the product. In this way, self-contained, closed products maintained by federal agencies give disabled employees and members of the public access to information that is comparable to access available to others. Manufacturers which intend to sell or lease self-contained, closed products to the U.S. government thus must be in full compliance with Section 508 of the U.S. Rehabilitation Act.

SUMMARY

In accordance with a first embodiment, there is disclosed a fuser assembly including a heat transfer member; a backup member being rotatable and disposed adjacent the heat transfer member so as to form a fuser nip with the heat transfer member; a frame in which the heat transfer member and the backup member are at least partly disposed; and a cover member pivotably coupled to the frame so as to pivot between a closed position and an open position, the cover member in the open position providing an opening for manually accessing and withdrawing a sheet of media disposed in the fuser assembly. The fuser assembly further includes a latch mechanism coupled to the cover member and the frame. The latch mechanism selectively latches the cover member to the frame and includes a lever member disposed relative to an outer surface of the cover member such that manipulation of the lever member by a single hand of a user unlatches the cover member from the frame for pivotably moving the cover member to the open position. In this way, a person with limited dexterity is able to relatively easily unlatch the cover member and gain access to the inner space of the fuser assembly for manually withdrawing a jammed sheet of media therefrom.

In an example embodiment, the latch mechanism includes a first member coupled to the cover member so as to pivot therewith, the first member being operatively coupled to the lever member such that rotation of the lever member rotates the first member; and a second member pivotably coupled to the frame. When the cover member is in the closed position, the second member latches onto the cover member to secure it to the frame. The second member is operatively coupled to the first member such that rotation of the first member moves the second member to unlatch the cover member from the frame.

The fuser assembly further includes a decurl roll and a decurl backup roll, the decurl roll and the decurl backup roll forming a decurl nip that is downstream, in a media feed direction, of the heat transfer member and the backup member. The decurl roll is coupled to the cover member so as to pivot therewith and the decurl backup roll is coupled and/or mounted to the frame. The decurl roll includes a decurl bushing such that when the cover member is in the closed position, the second member engages with the decurl bushing to latch the cover member to the frame.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
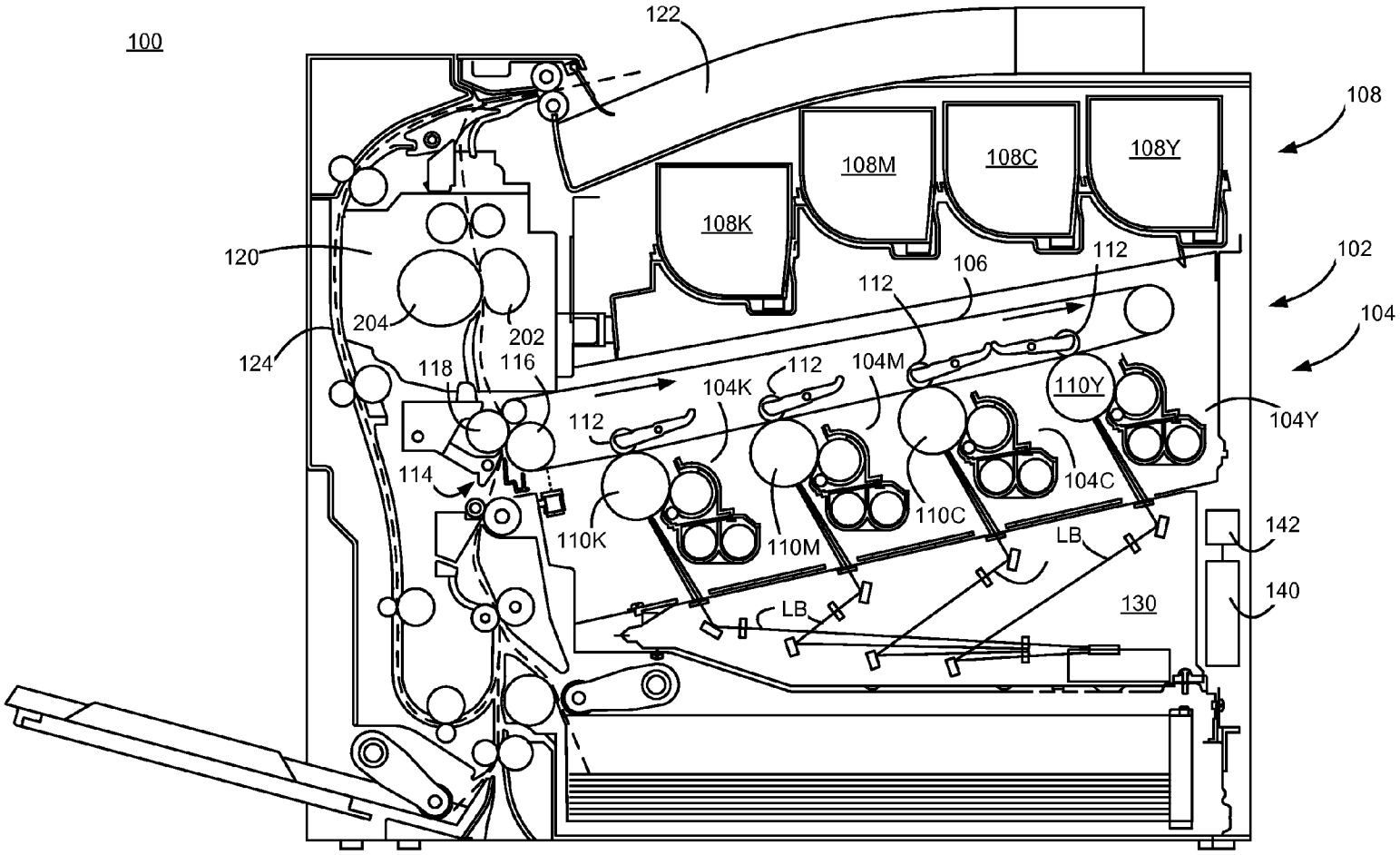
FIG. 1 is a side elevational view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and an herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104 that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 (108K, 108M, 108C and 108Y) for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming or imaging operations, ITM 106 moves past photoconductive members 110 in a clockwise direction as viewed in FIG. 1. One or more of photoconductive members 110 applies its toner image in its respective color to ITM 106. For mono-color images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Figure 2:
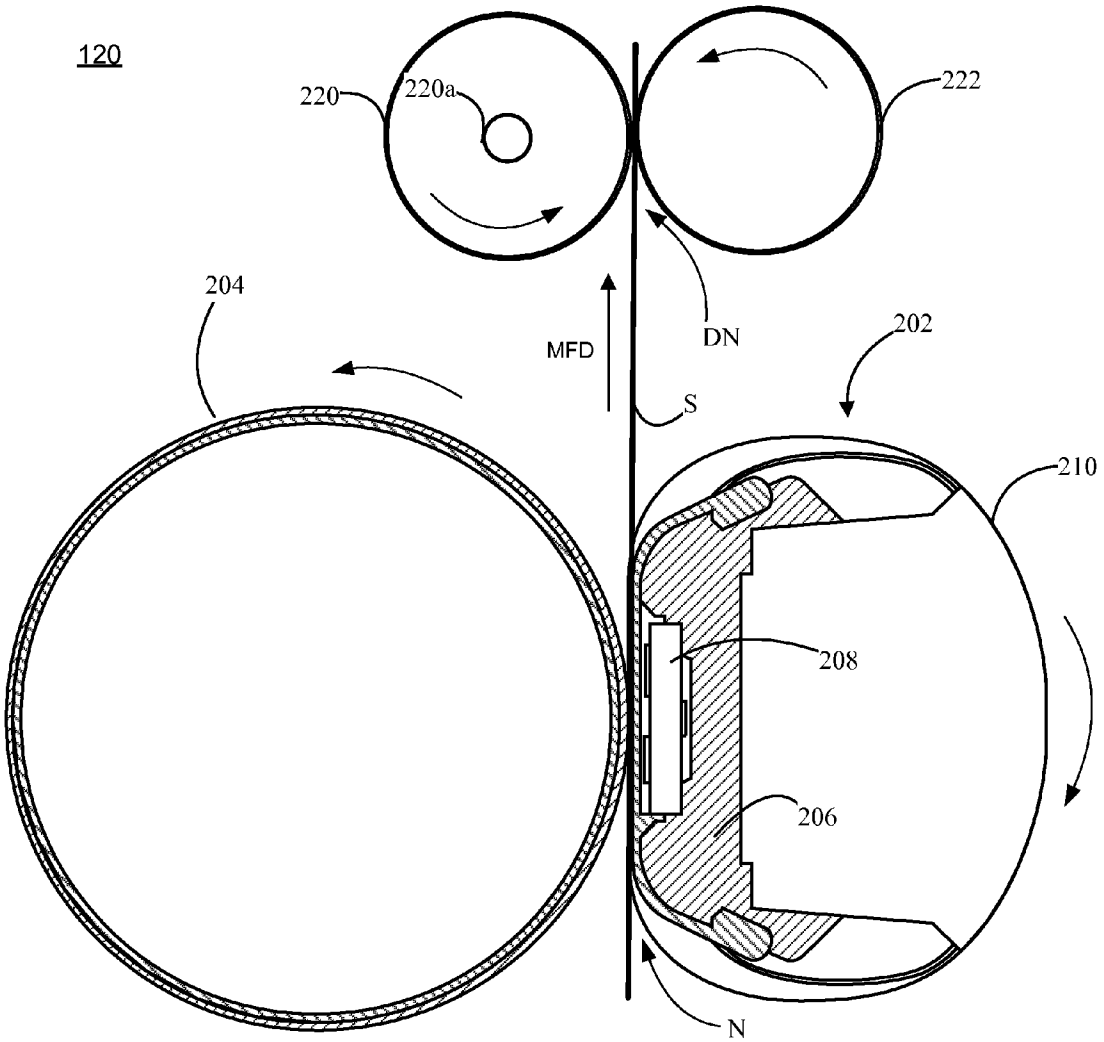
FIG. 2 is a simplified cross sectional view of a fuser assembly of the imaging device of FIG. 1, according to an example embodiment.

With respect to FIG. 2, in accordance with an example embodiment, there is shown fuser assembly 120 for use in fusing toner to sheets of media through application of heat and pressure. Fuser assembly 120 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. The inner surface of fuser belt 210 contacts the outer surface of heater member 208 so that heat generated by heater member 208 heats fuser belt 210. Heater member 208 may further include at least one temperature sensor, such as a thermistor, coupled to the substrate for detecting a temperature of heater member 208.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Fuser belt 210 and backup roll 204 may be largely constructed from the elements and in the manner as disclosed in U.S. Pat. No. 7,235,761, which is assigned to the assignee of the present application and the content of which is incorporated by reference herein in its entirety.

Fuser assembly 120 further includes a mechanism for decurling sheets of media that pass through fuser assembly 120. Referring again to FIG. 2, the decurling mechanism includes a decurl roll 220 and a decurl backup roll 222 disposed relative to decurl roll 220 to form a decurl nip DN. Decurl roll 220 and decurl backup roll 222 are disposed downstream of heat transfer member 202 and backup roll 204 in a media feed direction MFD. Decurl roll 220 and decurl backup roll 222 decurl a sheet of media S following media sheet S passing through fuser nip N. FIG. 2 depicts decurl roll 220 and decurl backup roll 222 as being roughly the same size. It is understood that they can have different diameters. Decurl roll 220 includes a center shaft 220*a* which forms the rotational axis of decurl roll 220 and bushings 220*b* (FIGS. 5 and 6) having a cylindrical portion that is disposed around shaft 220*a* at each end thereof. As will be discussed in greater detail below, one of the bushings 220*b* is used to latch decurl roll 220 in an operable position adjacent to decurl backup roll 222 so as to form decurl nip DN.

Figure 3:
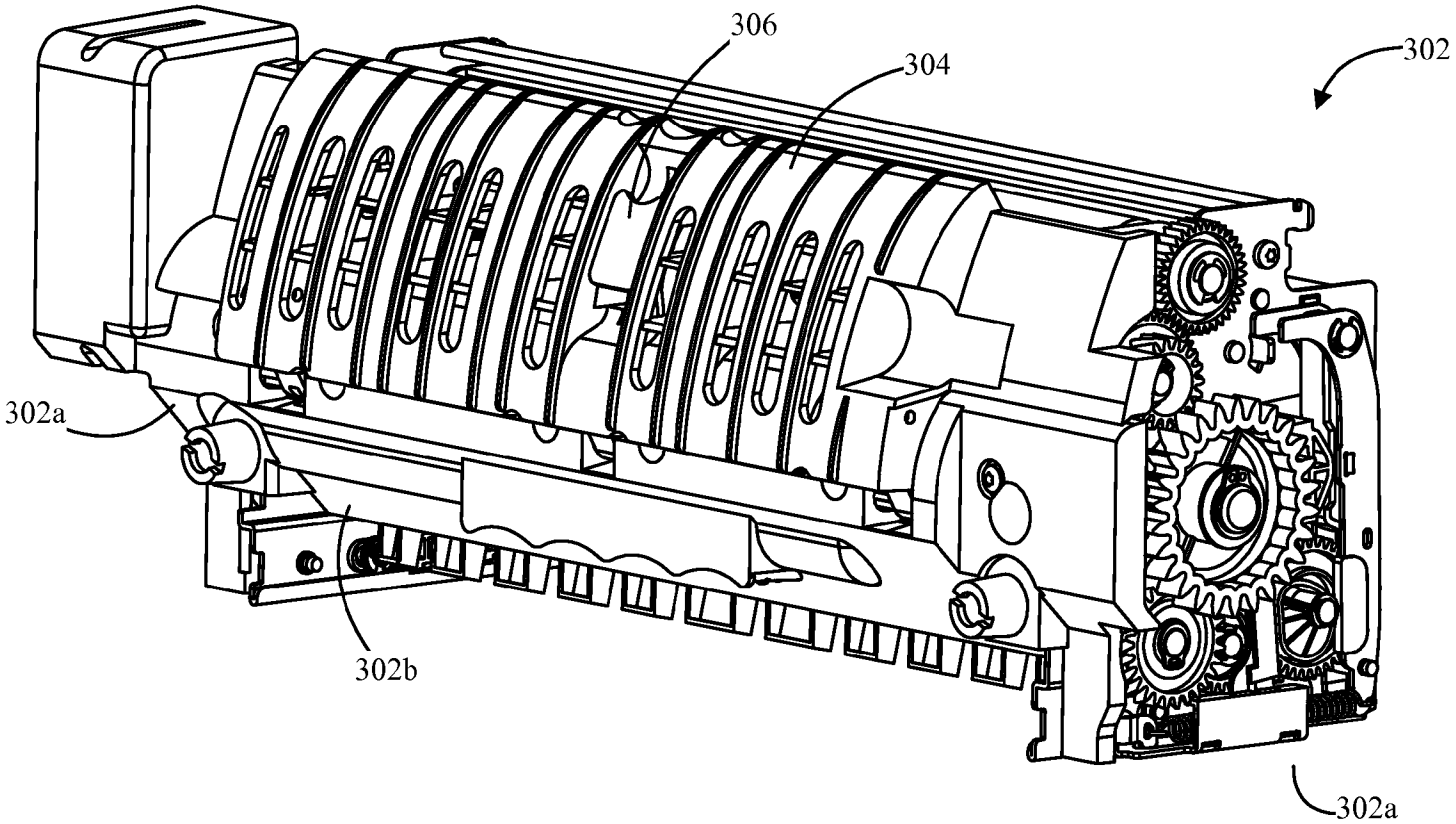
FIG. 3 is a perspective view of the fuser assembly of FIG. 2, according to an example embodiment.

As shown in FIG. 3, fuser assembly 120 includes a frame 302 to which the above-described components of fuser assembly 120 are coupled. In this way, heat transfer member 202, backup roll 204, decurl roll 220, decurl backup roll 222 and other components are coupled to frame 302 and located at least partly within a space defined thereby so that fuser assembly 120 can be treated as a single unit for replacement purposes. In an example embodiment, frame 302 includes side frame members 302*a* disposed at the length-wise end portions of frame assembly 120, front frame member 302*b* disposed along the front of frame assembly 120 and a back frame member (not shown) disposed along the back of frame assembly 120.

Figure 7A:
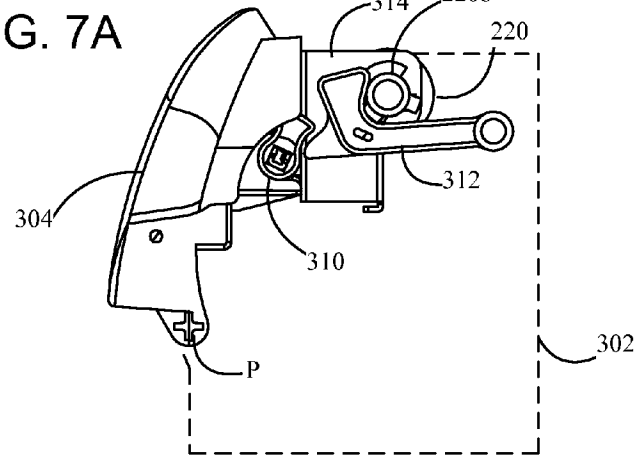
FIGS. 7A-7D are simplified side views of the fuser assembly of FIG. 3, according to an example embodiment, illustrating an unlatching operation of the latch mechanism of claim.
Figure 7B:
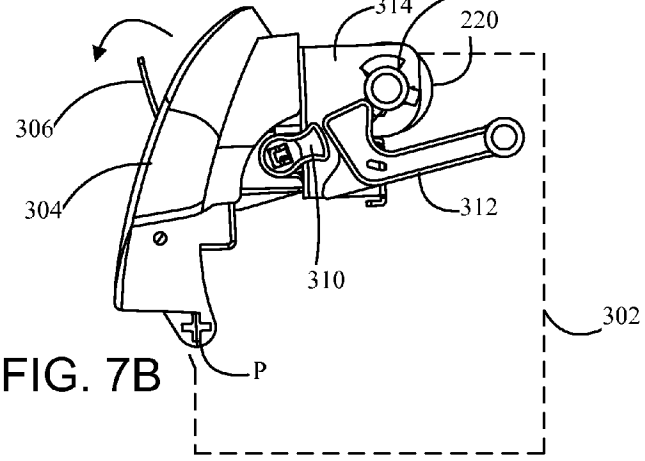
Figure 7C:
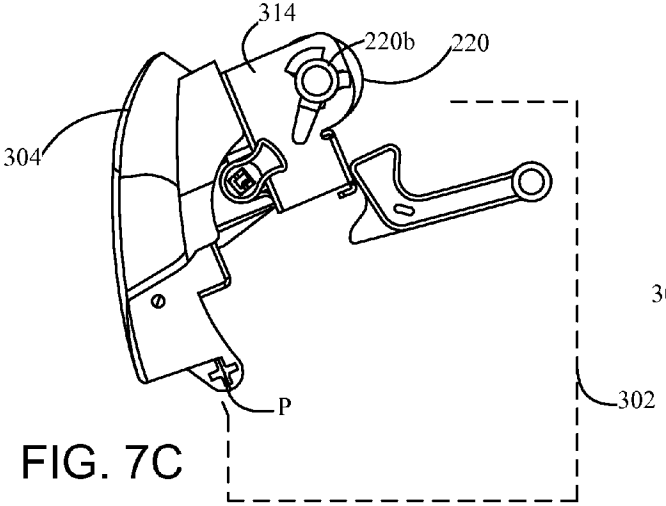
Figure 7D:
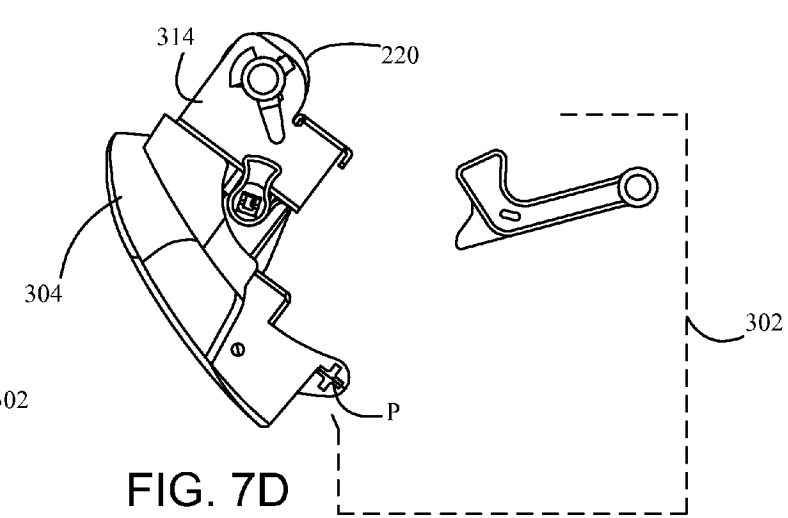

Fuser assembly 120 allows for a user of imaging device 100 to access an internal space of fuser assembly 120 so that the user can, for example, withdraw a sheet of media that is jammed in fuser assembly 120. Referring to FIGS. 3 and 7A-7D, and in accordance with an example embodiment, fuser assembly 120 includes a cover member 304. Cover member 304 extends substantially from one length-wise end of fuser assembly 120 to the other length-wise end thereof. The bottom portion of cover member 304 is pivotably coupled to frame 302 at pivot point P (FIGS. 7A-7D) so that cover member 304 pivots outwardly therefrom, between a closed position in which cover member 304 is positioned against frame 302 (FIGS. 3 and 7A) and an open position in which cover member 304 is fully opened relative to frame 302 (FIG. 7D). Cover member 304 serves as a cover to the inner space of fuser assembly 120 such that when cover member 304 is in the closed position, the inner space of fuser assembly 120 cannot be manually accessed, and when cover member 304 is in the open position, an opening is formed for accessing the inner space of fuser assembly 120. The opening is large enough for a user to at least partly insert the user's hand into the inner space of fuser assembly 120 for removing a jammed sheet of media from the inner space.

Cover member 304 also serves as part of the media path for imaging device 100. Specifically, when fuser assembly is operably positioned within imaging device 120 (FIG. 1) and with cover member 304 in the closed position, the outer surface of cover member 304 forms part of duplex media path 124 for transporting a sheet of media to second transfer area 114 for imaging on a second surface of the media sheet.

Bias members 320 (FIG. 4) are coupled between frame 302 and cover member 304 so as to bias cover member 304 partly outwardly from its closed position against front frame member 302*b*. In an example embodiment, each bias member 320 is a torsion spring having a first end positioned against front frame member 302*b* and a second end positioned against an inner surface of cover member 304.

In example embodiments, decurl roll 220 is coupled to cover member 304 so as to pivot with cover member 304. Fuser assembly 120 includes side panels 314 (FIGS. 4 and 7A-7D) that are connected to and extend from the length-wise ends of an inner portion of cover member 304. Side panels 314 include apertures for receiving bushings 220*b* therein. In this way, decurl roll 220 is mounted to side panels 314 and rotatable about shaft 220*a*. Coupling decurl roll 220 to cover member 304 so as to pivot therewith allows for decurl nip DN to be sufficiently opened so that a user of imaging device 100 is able to access the inner space of fuser assembly 120 that is downstream of heat transfer member 202 and backup roll 204. As a result, by pivoting cover member and decurl roll 220 so that decurl roll 220 sufficiently separates from decurl backup roll 222, a user is able to manually withdrawn a sheet of media that is jammed between fusing nip N and decurl nip DN, or that has been wrapped around heat transfer member 202 or backup roll 204.

Figure 5:
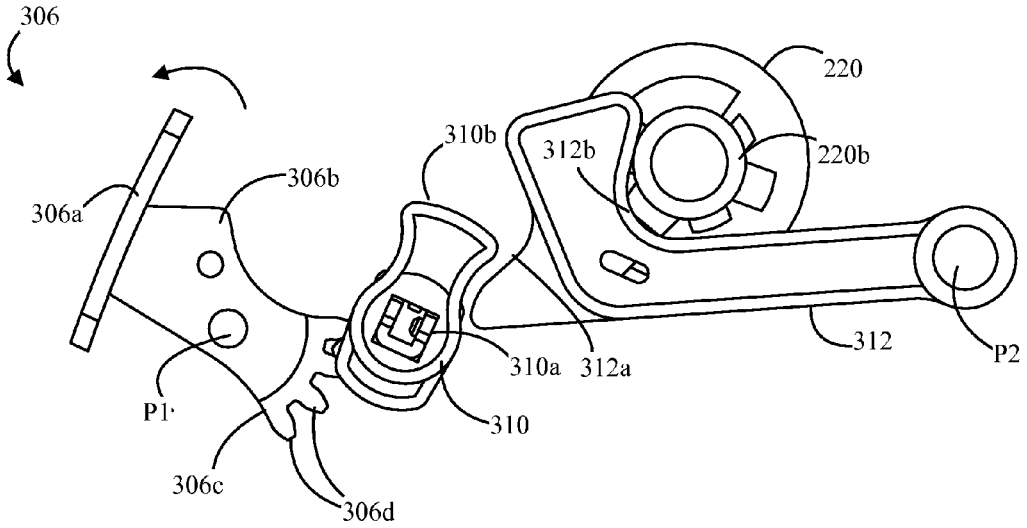
FIGS. 5 and 6 are simplified side views of a latch mechanism of the fuser assembly of FIG. 3, according to an example embodiment.
Figure 6:
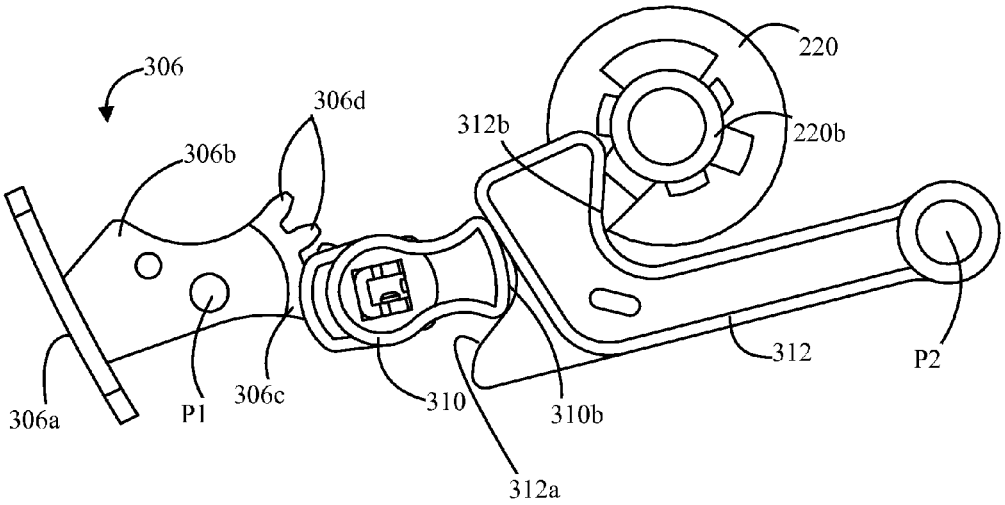

According to example embodiments, fuser assembly 120 includes a latch mechanism for latching or coupling cover member 304 and decurl roll 220, either directly or indirectly, to frame 302 when cover member 304 is in the closed position so that fuser assembly 120 can perform a fusing operation, and for unlatching or decoupling cover member 304 and decurl roll 220 from frame 302 so that cover member 304 can be pivotally opened for manually accessing a jammed sheet of media in the inner space of fuser assembly 120 downstream of fusing nip N. In an example embodiment, the latch mechanism includes a lever member 306 which, when activated, causes cover member 304 and decurl roll 220 to decouple from frame 302. Lever member 306 is disposed in a largely central portion along cover member 304, as shown in FIG. 3. Referring to FIGS. 5 and 6, lever member 306 is also pivotably coupled to cover member 304 about pivot point P1 and includes a first section 306*a* which is sized and dimensioned for being manipulated by a user's hand or finger; a second section 306*b* which extends from first section 306*a* and includes pivot point P1; and a third section 306*c* which is disposed at an opposite end of second section 306*b* from first section 306*a* and includes teeth 306*d*. When cover member 304 is in the closed position and decurl roll 220 forms decurl nip DN with decurl backup roll 222, first section 306*a* of lever member 306 is disposed so as to be largely flush with the outer surface of cover member 304. Pulling a top end of first section 306*a* outwardly from cover member 304 when cover member 304 is in the closed position causes lever member 306 to rotate about pivot point P1 in a first direction (counterclockwise as viewed from FIGS. 5 and 6).

Figure 4:
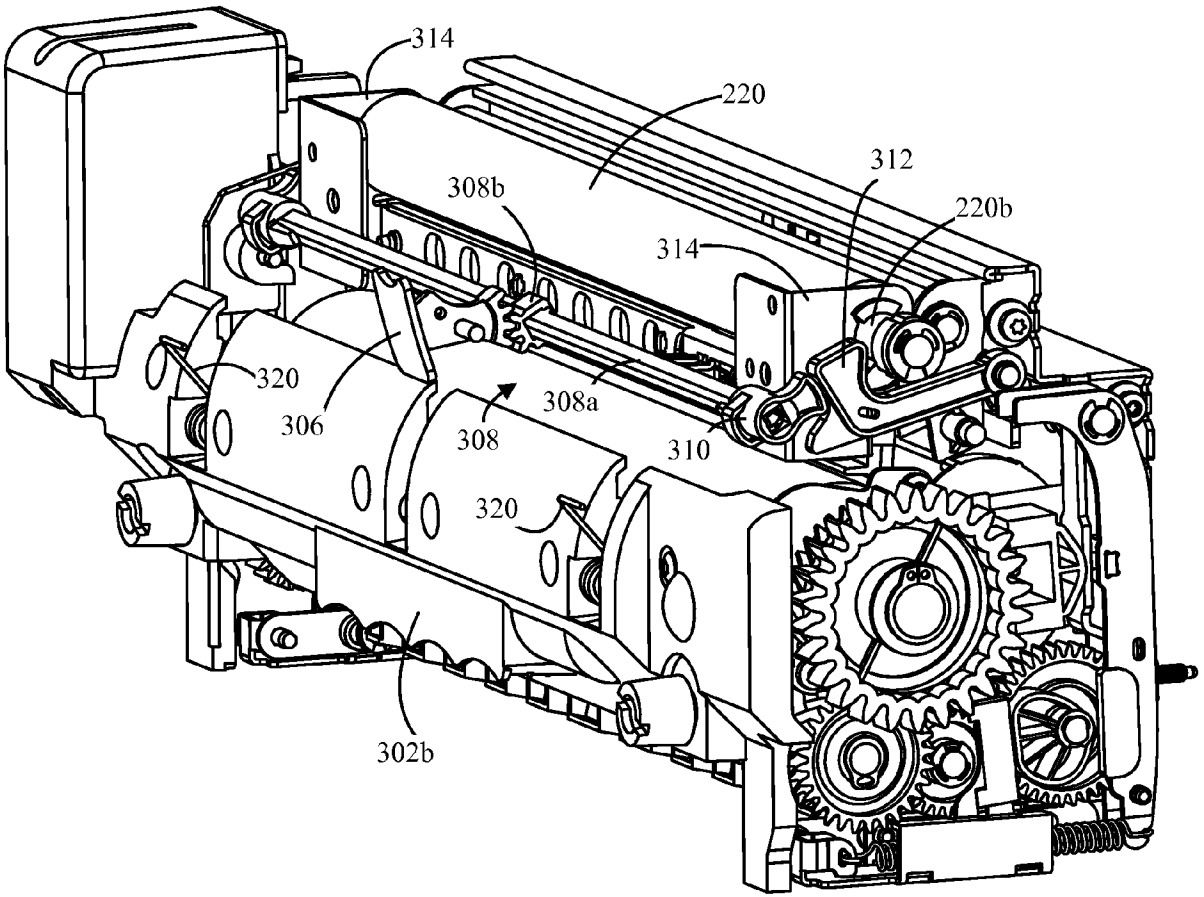
FIG. 4 is a perspective view of the fuser assembly of FIG. 3 with its cover member missing.

As best seen in FIG. 4 which shows fuser assembly 120 without cover member 304, the lever mechanism further includes a linkage member 308 which is coupled to cover member 304 and engages with lever member 306. Linkage member 308 includes a shaft 308*a* that substantially extends the length of fuser assembly 120. Shaft 308*a* may have a non-circular cross section. Linkage member 308 further includes a gear member 308*b* which is secured to shaft 308*a* and has gear teeth which engage with gear teeth 306*d* of lever member 306. Rotation of lever member 306 in the first (counterclockwise) direction causes gear member 308*b* and shaft 308*a* to rotate in a second (clockwise) direction.

The latch mechanism further includes a cam member 310 which is attached to an end of shaft 308*a* such that cam member 310 rotates with shaft 308*a*. Cam member 310 may include an aperture 310*a* through which the end of shaft 308*a* is inserted so that cam member 310 rotates with shaft 308*a*. A distal end of cam member 310 includes a cam surface 310*b* (FIGS. 5 and 6).

The latch mechanism further includes an arm member 312. Arm member 312 is elongated having a first end that is pivotably connected to frame 302 at pivot point P2. Best seen FIGS. 4 and 5, distal end portion of arm member 312 includes a first curved surface 312*a* which contacts cam surface 310*b* of cam member 310, and a second curved surface 312*b*. Rotation of cam member 310 in the second (clockwise) direction causes cam surface 310*b* to contact first curved surface 312*a* of arm member 312 and urge arm member 312 to rotate in the first (counterclockwise) direction.

In example embodiments, arm member 312 is used to latch decurl roll 220 in a position proximal to decurl backup roll 222 so as to form decurl nip DN, and in doing so serves to latch cover member 304 in the closed position. When decurl roll 220 is in its operable position proximal to decurl backup roll 222 to form decurl nip DN, as shown in FIG. 5, second curved surface 312*b* of arm member 312 cradles bushing 220*b*. The distal end of second curved surface 312*b* extends from arm member 312 such that decurl roll 220 and bushing 220*b* are unable to pivot or otherwise move relative to frame 302 of fuser assembly 120.

The operation of the latch mechanism will be described with reference to FIGS. 7A-7D. FIG. 7A depicts cover member 304 in the closed position in which bushing 220*b* of decurl roll 220 contacts and is latched in place by second curved surface 312*b* of arm member 312. In this position, decurl roll 220 forms decurl nip DN with decurl backup roll 222 which decurls media sheets passing through decurl nip DN. Due to side panels 314 connecting together cover member 304 and decurl roll 220, arm member 312 latching decurl roll 220 in place also latches cover member 304 in the closed position.

When a user desires to gain access to the inner space of fuser assembly 120 to remove a jammed sheet of media, for example, the user pulls lever member 306 so that it pivots about pivot point P1 relative to latched cover member 304. As shown in FIG. 7B, lever member 306 is pivoted in the counterclockwise direction. Pivoting lever member 306 in the counterclockwise direction causes cam member 310 to pivot in the clockwise direction so that cam surface 310*b* of cam member 310 contacts first curved surface 312*a*. Upon cam surface 312*a* contacting first surface 312*a* of cam member 310, further rotation of cam member 312 in the clockwise direction, as viewed from FIGS. 5, 6 and 7A-7D, causes arm member 312 to rotate or pivot about pivot point P2 in the counterclockwise direction. Sufficient rotation of arm member 312 in the counterclockwise direction causes second curved surface 312*b* to overcome its interference with bushing 220*b* so that arm member 312 disengages from bushing 220*b*, as shown in FIG. 7B. Once arm member 312 disengages from bushing 220, bias members 320 present bias forces on cover member 304 so that cover member 304 further opens to some extent, as shown in FIG. 7C. At this point, cover member 304 may be manually pivoted to its most open position, as shown in FIG. 7D, so that the opening formed between the top of cover member 304 and the remainder of fuser assembly 120 that is fixed to frame 302 is sufficient to allow a user to insert his/her hand into the inner space of fuser assembly 120.

Figure 8B:
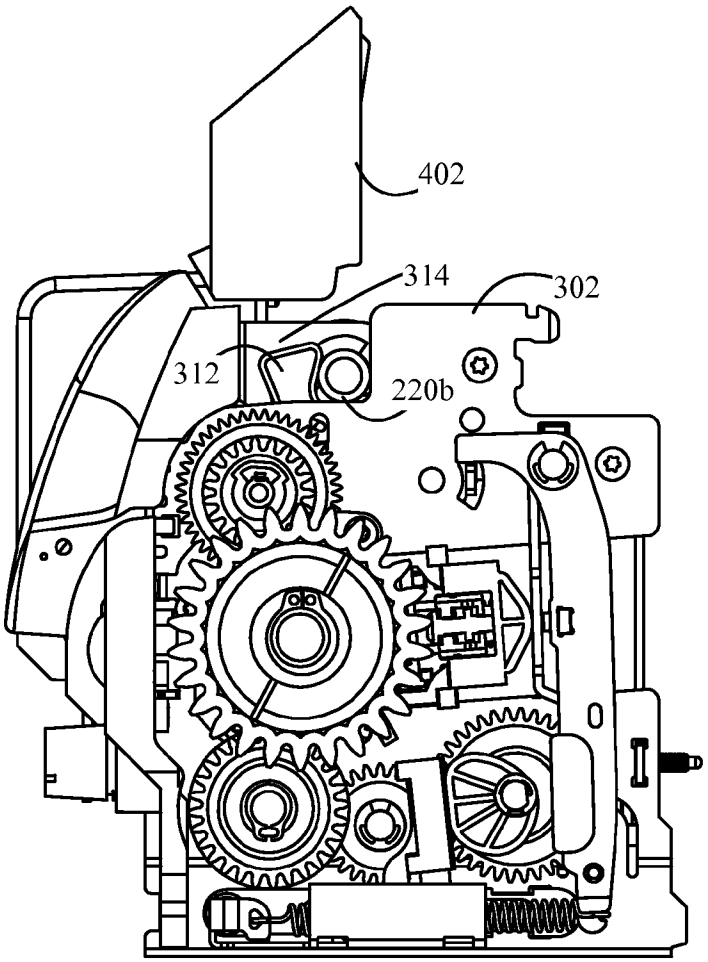
FIGS. 8A and 8B are side elevational views of the fuser assembly of FIG. 2 illustrating the latch operation of the latch mechanism, according to an example embodiment.
Figure 8A:
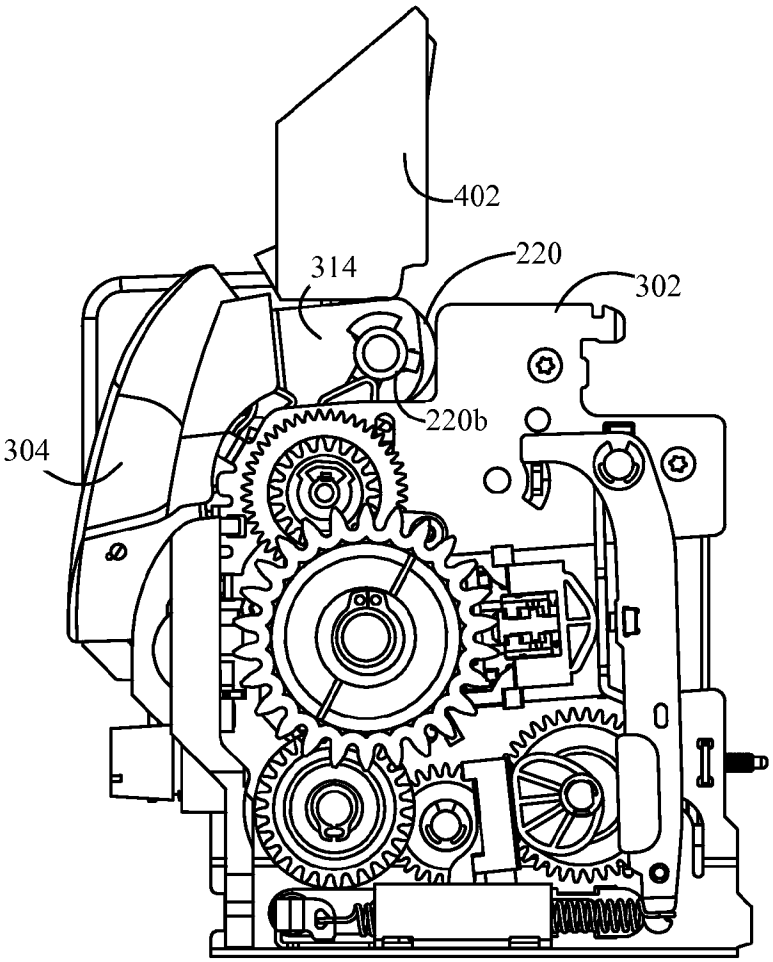

Following cover member 304 being opened to, for example, remove a jammed sheet of media in the internal space of fuser assembly 120, cover member 304 is latched into the closed position by first manually pivoting cover member 304 near the latched position, as shown in FIG. 8A. In this position, bushing 220*b* of decurl roll 220 may contact an end of second curved surface 312*b*, but is not in its latched position. In an example embodiment, imaging device 100 includes a door or lid (not shown) which, when opened, provides access to an inner space of imaging device 100. The door may be pivotably coupled to the frame of imaging device 100 so that when the door is closed, the door forms a top portion of imaging device 100. Extending largely downwardly from an undersurface of the door is extension 402. After cover member 304 is placed near its closed, latched position as shown in FIG. 8A, the user may continue to pivot cover member 304 in the clockwise position until bushing 220*b* overcomes the interference with arm member 312 and is cradled against second curved surface 312*b*. Alternatively, closing the door of imaging device 100 causes extension 402 to move substantially downwardly so that it contacts and urges frame 314 (and with it, cover member 304) to pivot until bushing 220*b* overcomes its interference with arm member 312 and is cradled against second curved surface 312*b* (FIG. 8B).

An advantage of the latch mechanism as described above is that cover member 304 may be unlatched from frame 302 of fuser assembly 120 by using only one hand, via manipulating lever member 306. Users with limited dexterity may thus easily access the inner space of fuser assembly 120.

The description of the details of the example embodiments have been described in the context of a color electrophotographic imaging devices. However, it will be appreciated that the teachings and concepts provided herein are applicable to monochrome electrophotographic imaging devices and multifunction products employing electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A fuser assembly, comprising:

a heat transfer member;

a backup member being rotatable and disposed adjacent the heat transfer member so as to form a fuser nip with the heat transfer member;

a frame in which the heat transfer member and the backup member are at least partly disposed;

a cover member pivotably coupled to the frame so as to pivot between a closed position and an open position, the cover member in the open position providing an opening for accessing and withdrawing a sheet of media disposed in the fuser assembly; and a latch mechanism coupled to the cover member and the frame, the latch mechanism selectively latching the cover member to the frame and including a lever member disposed relative to an outer surface of the cover member such that movement of the lever member by a single hand of a user unlatches the cover member from the frame for moving the cover member to the open position, wherein the latch mechanism includes a first member coupled to the cover member so as to pivot therewith, the first member being operatively coupled to the lever member such that rotation of the lever member rotates the first member, and a second member pivotably coupled to the frame, wherein when the cover member is in the closed position and latched to the frame, the second member is latched to the cover member, and wherein the second member is operatively coupled to the first member such that rotation of the first member pivots the second member to unlatch the cover member from the frame.

2. The fuser assembly of claim 1, wherein the latch mechanism comprises at least one spring member coupled between the cover member and the frame, the at least one spring member urging the cover member towards the open position.

3. The fuser assembly of claim 1, wherein the lever member is pivotably coupled to the cover member and pivots outwardly therefrom when the cover member is in the closed position and latched to the frame, to unlatch the cover member from the frame.

4. The fuser assembly of claim 1, wherein the second member includes a first end pivotably coupled to the frame and a distal end engageable with the first member.

5. The fuser assembly of claim 1, further comprising a decurl roll and a decurl backup roll, the decurl roll and the decurl backup roll forming a decurl nip that is downstream, in a media feed direction, of the heat transfer member and the backup member, wherein the decurl roll is coupled to the cover member so as to pivot therewith and the decurl backup roll is coupled to the frame.

6. The fuser assembly of claim 5, wherein the decurl roll includes a decurl bushing, and wherein when the cover member is in the closed position, the second member engages with the decurl bushing to latch the cover member to the frame.

7. The fuser assembly of claim 6, wherein the second member has a first end portion that is pivotably coupled to the frame and a second end portion that includes a first surface for engaging with the first member and a second surface which engages with the decurl bushing for latching the cover member to the frame.

8. The fuser assembly of claim 1, wherein the latch mechanism further comprises a shaft coupled between the lever member and the first member.

9. The fuser assembly of claim 1, wherein the lever member is disposed along a length-wise central portion of the fuser assembly and the first and second members are disposed along a length-wise end portion of the fuser assembly.

10. A fuser assembly, comprising:

a heat transfer member;

a backup member being rotatable and disposed adjacent the heat transfer member so as to form a fuser nip with the heat transfer member;

a frame in which the heat transfer member and the backup member are at least partly disposed;

a decurl roll and a decurl backup roll positioned relative to the decurl roll for forming a decurl nip therewith, the decurl nip being disposed downstream from the fuser nip in a media feed direction through the fuser assembly, the decurl roll being pivotably coupled to the frame so as to move between a first position in which the decurl roll is positioned proximal to the decurl backup roll and forms the decurl nip therewith and a second position in which the decurl roll is positioned sufficiently apart from the decurl backup roll so as to allow for manual removal of a sheet of media disposed within the fuser assembly; and a latch mechanism coupled to the decurl roll and the frame, the latch mechanism including a lever member and configured for selectively latching the decurl roll in the first position and unlatching the decurl roll from the first position responsive to manual activation of the lever member with a single one of a user's hand, wherein the decurl roll comprises a shaft and a decurl bushing disposed around the shaft at a length-wise end portion of the decurl roll, and the latch mechanism selectively engages with the decurl bushing so as to latch the decurl roll in the first position.

11. The fuser assembly of claim 10, wherein the latch mechanism comprises a latch arm member disposed between the lever member and the decurl bushing when the decurl roll is latched in the first position such that movement of the lever member causes the latch arm member to disengage from the decurl bushing so as to unlatch the decurl roll.

12. The fuser assembly of claim 11, wherein the latch mechanism further comprises a cam member coupled between the lever member and the latch arm member such that when the decurl roll is latched in the first position, movement of the lever member causes the cam member to rotate and the latch arm member to disengage from the decurl bushing so as to unlatch the decurl roll.

13. The fuser assembly of claim 12, wherein the cam member and the latch arm member are disposed along a length-wise end portion of the fuser assembly and the lever member is disposed along a length-wise central portion of the fuser assembly.

14. The fuser assembly of claim 13, further comprising a shaft member coupled between the lever member and the cam member.

15. The fuser assembly of claim 13, wherein the latch arm member is pivotably coupled to the frame and the lever member and the cam member are coupled to the decurl roll so as to pivot therewith when the decurl roll moves between the first and second positions.

16. The fuser assembly of claim 15, further comprising a cover member rotatably coupled to the frame and coupled to the decurl roll so that the cover member, the decurl roll, the lever member and the cam member are pivotable in unison when the decurl roll is unlatched from the frame.

17. A fuser assembly, comprising:

a heat transfer member;

a backup member being rotatable and disposed adjacent the heat transfer member so as to form a fuser nip with the heat transfer member;

a frame in which the heat transfer member and the backup member are at least partly disposed;

a decurl roll and a decurl backup roll positioned relative to the decurl roll for forming a decurl nip therewith, the decurl nip being disposed downstream from the fuser nip in a media feed direction through the fuser assembly, the decurl roll being pivotably coupled to the frame so as to move between a first position in which the decurl roll is positioned proximal to the decurl backup roll and forms the decurl nip therewith and a second position in which the decurl roll is positioned sufficiently apart from the decurl backup roll so as to allow for manual removal of a sheet of media disposed within the fuser assembly;

a latch mechanism coupled to the decurl roll and the frame, the latch mechanism including a lever member and configured for selectively latching the decurl roll in the first position and unlatching the decurl roll from the first position responsive to manual activation of the lever member with a single one of a user's hand; and a cover member rotatably coupled to the frame and coupled to the decurl roll so that the cover member, the decurl roll, and the lever member pivot in unison when the decurl roll is unlatched from the frame.

18. The fuser assembly of claim 17, wherein the cover member extends across a major portion of the fuser assembly in a length-wise direction thereof, and the lever member is disposed along a central portion of the fuser assembly in the length-wise direction.

* * * * *